US007066300B2

(12) United States Patent
Sylvia

(10) Patent No.: US 7,066,300 B2
(45) Date of Patent: Jun. 27, 2006

(54) METHOD USING A CLIMBING TREE STAND APPARATUS

(75) Inventor: Michael Sylvia, Acushnet, MA (US)

(73) Assignee: Shaun Martin, Midway, GA (US), part interest ( * ) Notice: Subject to any disclaimer, the term of this patent is extended or adjusted under 35 U.S.C. 154(b) by 4 days.

(21) Appl. No.: 10/864,629

(22) Filed: Jun. 9, 2004

(65) Prior Publication Data

US 2005/0284700 A1 Dec. 29, 2005

(51) Int. Cl.
*A63B 27/00* (2006.01)
*E04G 3/00* (2006.01)

(52) U.S. Cl. ..... 182/135; 182/187

(58) Field of Classification Search ..... 182/135, 182/136, 187, 20, 188, 110; 297/217.1; 108/152
See application file for complete search history.

(56) References Cited

U.S. PATENT DOCUMENTS 3,961,686 A * 6/1976 Starkey ..... 182/187
5,492,198 A * 2/1996 Williams ..... 182/136
5,680,910 A * 10/1997 Sarphie, IV ..... 182/135
5,971,104 A * 10/1999 Woller ..... 182/136

* cited by examiner

*Primary Examiner*—Hugh B. Thompson, II
(74) *Attorney, Agent, or Firm*—Barlow, Josephs & Holmes, Ltd.

(57) ABSTRACT

An climbing tree stand apparatus for use in conjunction with a tree stand that is mounted on a tree, the apparatus comprising: a load-bearing member adapted to be graspable by a user of the tree stand; and at least one point of attachment associated with the load-bearing member, wherein the apparatus is adapted to be attached to the tree stand at the at least one point of attachment such that at least a portion of the load-bearing member extends below an underside of the tree stand. The climbing tree stand apparatus is lightweight and compact and therefore, easy to carry.

2 Claims, 2 Drawing Sheets

METHOD USING A CLIMBING TREE STAND APPARATUS

STATEMENT OF GOVERNMENT INTEREST

Not Applicable.

CROSS-REFERENCE TO RELATED APPLICATIONS

None.

BACKGROUND OF THE INVENTION (1) Field of the Invention

This invention relates generally to a climbing tree stand apparatus and method for execution by a user of a climbing tree stand.

(2) Description of Related Art

Many hunters while waiting to acquire their prey have chosen to use an elevated tree mounted hunting stand or climbing tree stand. The tree climbing stand engages a tree for supporting a hunter above the ground so that the prey does not know the hunter is in the area. In selecting the perfect site to set up his tree stand the hunter will sometimes walk a great distance from the hunter's vehicle to the location of the tree where the hunter will want to set up a tree stand. While making the trek to the tree stand, the hunter will have to carry many items with him, such as his weapon, other accessories and the tree stand. Therefore, any climbing tree stand design or climbing tree stand accessories should be as lightweight and compact as possible to allow the hunter to carry the items a great distance.

After the hunter has mounted the tree stand to the tree, the hunter has to climb onto the tree stand. If the trunk of the tree is round, similar to that of a telephone pole, the climbing tree stand would be attached rather easily and it would also be level at the base of the tree. However, because most trees have thicker trunks then the rest of the tree, when the hunter attaches the climbing tree stand to the tree trunk, the stand will not be level. A worse case would be to have the tree stand be at a steep angle in addition to it being several feet from the ground. The hunter then has to try to climb onto a tree stand that is not level and therefore could cause a potentially dangerous situation for the hunter. Reaching the elevated tree stand presents obvious difficulties to the hunter whether the stand is level or not. While making the ascent to the elevated tree stand, the hunter must bring the necessary weapon and other accessories required by them, a task complicated by the need to use all the hunter's limbs in successfully climbing the tree, while climbing the tree stand. Many of the present tree climbing stands include an upper platform and a cooperating lower foot platform (lower platform). The upper platform is positioned above the lower platform. The hunter first climbs onto the foot platform and raises and secures the upper platform to the tree. The present invention relates to a climbing tree stand apparatus that can be attached to a tree stand as an aid for assisting a person in getting up and easily onto a tree stand or getting down from a tree stand.

SUMMARY OF THE INVENTION

Accordingly, the invention is a climbing tree stand apparatus for use in conjunction with a tree stand that is mounted on a tree, the apparatus comprising a load-bearing member adapted to be graspable by a user of the tree stand and at least one point of attachment associated with the load-bearing member wherein the apparatus is adapted to be attached to the tree stand at the at least one point of attachment such that at least a portion of the load-bearing member extends below an underside of the tree stand. Furthermore, the invention provides a method for execution by a user of a climbing tree stand apparatus, the method comprising attaching a support member to a tree stand, wherein at least a portion of the support member extends below an underside of the tree stand; mounting the tree stand on a tree; and supporting at least a portion of the user's weight with the support member while climbing into the tree stand.

DESCRIPTION OF THE PREFERRED EMBODIMENT

Figure 1:
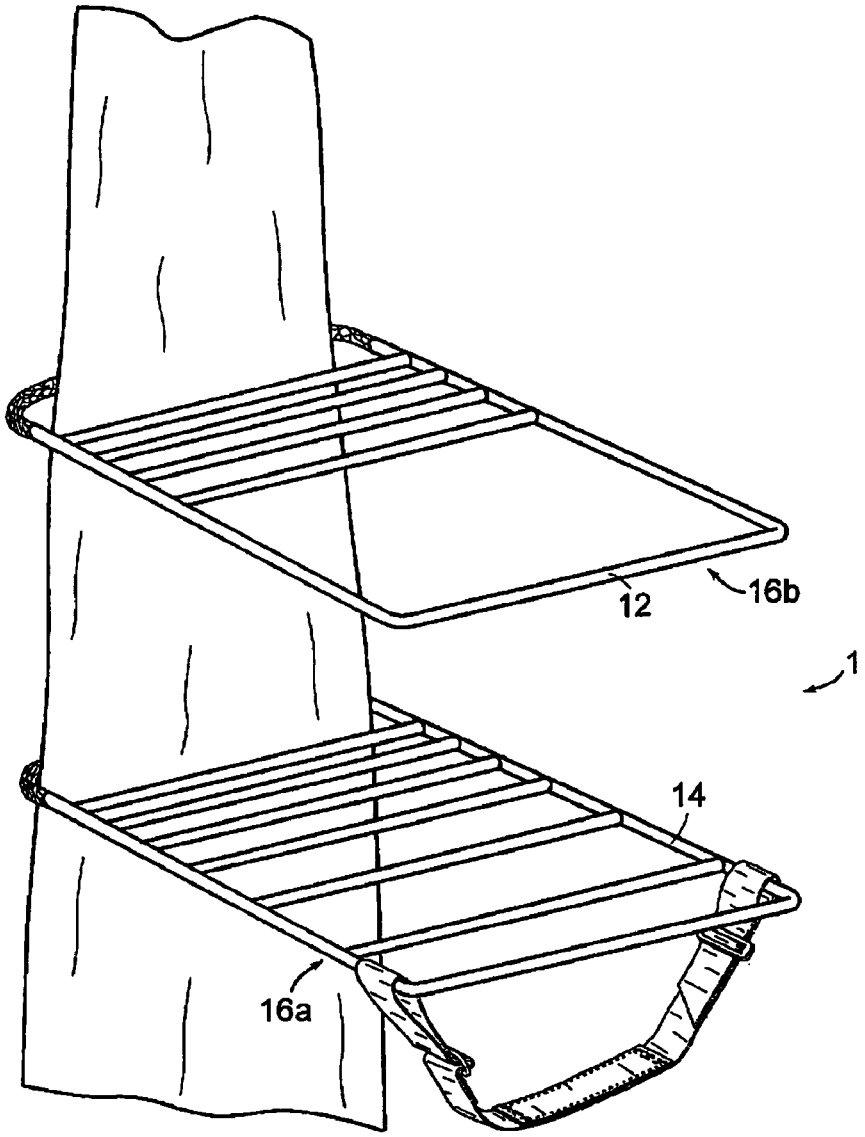
FIG. 1 is a perspective view a tree stand with the climbing tree stand apparatus attached thereto thereby showing one embodiment according to the invention.
Figure 2:
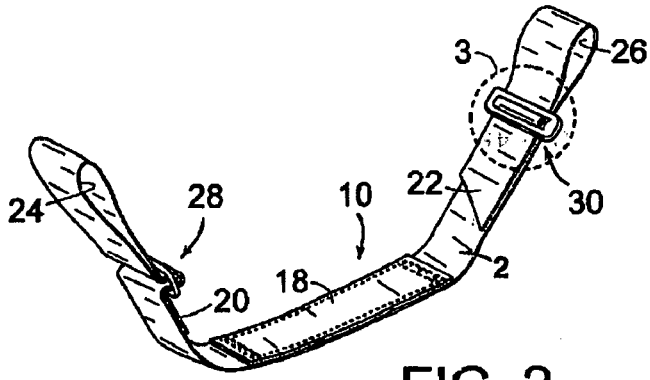
FIG. 2 is a perspective view of the climbing tree stand apparatus.
Figure 3:
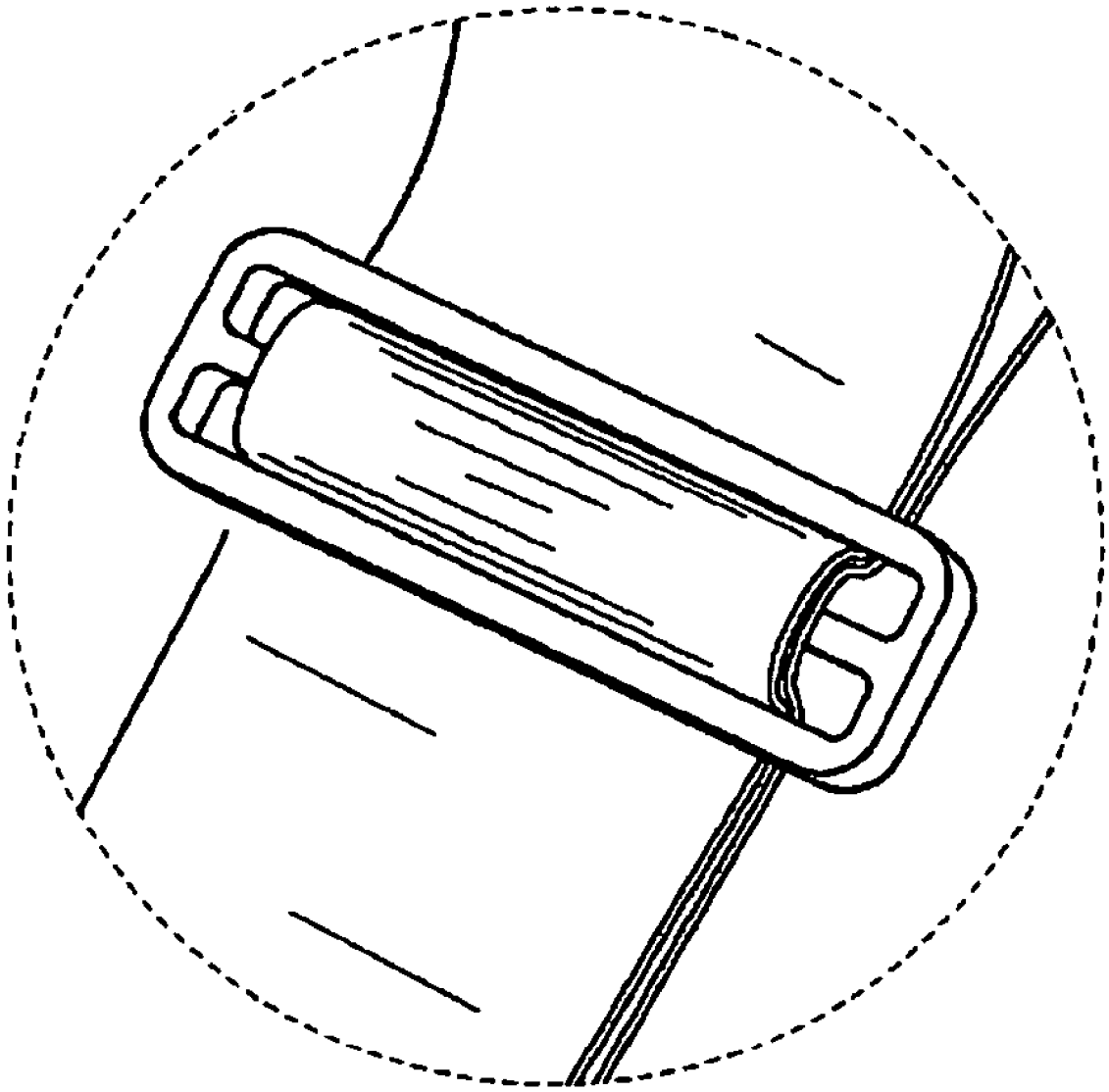
FIG. 3 is a perspective view of the climbing tree stand apparatus fastener.

Referring more particularly to FIGS. 1–3, wherein like numbers refer to similar parts climbing tree stand 1 and climbing tree stand apparatus 10 are shown according to the present invention. The climbing tree stand 1 shown includes an upper 12 and a lower 14 structure for supporting the user and the detachable climbing tree stand apparatus 10, thereby showing the preferred embodiment according to the invention. Both the upper 12 and the lower structure 14 of the tree stand 1 consists of an outer platform rail, 16*a* (lower) and 16*b* (upper) respectively, thereby allowing for the climbing tree stand apparatus 10 to be attached to opposite sides of the outer rail 16*a* of the lower structure 14 of a climbing tree stand 1. Even though this particular climbing tree stand is shown, it is only used as way to describe the apparatus use with a climbing tree stand 1; and therefore, the climbing tree stand apparatus 10 can be used on other climbing tree stands and is not limited to being used on this climbing tree stand only.

As best shown in FIGS. 1 and 2, the apparatus, 10, comprises a load-bearing member adapted to be detachable by a user of the tree stand 1. The apparatus 10 is attached at two points to the tree stand 1 such that at least a portion of the load-bearing member extends below an underside of the tree stand 1. The load-bearing member of the apparatus 10 is constructed of a flexible material that hangs freely, and generally in an arciform path having two endpoints 20 and 22, when attached to the tree stand 1. As shown in FIG. 2, the load-bearing member is constructed from a ribbon of flexible sheet material having two ends 20 and 22 that terminate in a loop 24, 26. Each of the loops, 24 and 26 respectively, is formed by placing one end 20 of the apparatus 10 around one side of the platform tube 16*a* of the lower structure 14 and then looping it back onto itself. On each opposite end of the apparatus 10 is a retaining bracket, 28 and 30, respectively, that retains and holds the loops in place. One of the brackets, 30, can be seen in more detail in FIG. 3. Each bracket, 28 and 30, respectively, is used to tighten and secure each end, 24 and 26, of the apparatus 10 around each side of the lower platform 16*a*.

FIG. 2, shows the apparatus 10 with a reinforcement member 18 wherein the reinforcement member is attached to the load-bearing member so as to increase the load-bearing capacity. The reinforcement member 18 can be used to support a heavier person and in this figure is made of the same material as the load bearing member and as also shown in this figure is sewn to the load-bearing member.

When the apparatus 10 is attached to the climbing tree stand 1 by a user, the user first places the ends 20 and 22 of the load bearing member over the tree stand platform 16*a* from the outside of the platform 16 and overlaps the platform rail. The user then weaves the end of the load bearing member through the inside of the buckle and back again and at the same time carefully removing any slack. The apparatus 10 is then attached to the climbing tree stand 1 as shown in FIG. 1. The apparatus 10 when attached to the climbing tree stand reduces the platform height thereby making it easier for the user to get onto the stand 1. The user is then able to place both hands on the upper platform 12 of the climbing tree stand 1 and at the same time is able to place one foot on the apparatus 10 instead of placing one foot directly onto the lower platform 14. Because the user is able to place one foot on the apparatus 10 instead of directly onto the lower platform 14, the user is able to support himself while trying to get onto the lower platform 14. If the platforms are level then the task of getting onto the platforms 14 and 16 is easy. When the platforms 14 and 16 are not level and are at an angle, without the use of the apparatus 10, it is a very difficult task for a user to climb onto the tree stand 1. After the user has two hands on the upper platform 12 and a foot on the apparatus 14, the user is able to both push with one foot on the ground, one foot on the apparatus 10 and simultaneously pull his body by his two hands onto the platform 16 of the tree stand 1. The apparatus 10 allows the user to mount the tree stand 1 on a tree while supporting at least a portion of the user's weight with the support member while climbing into the tree stand 1.

The apparatus 10 can be made or formed using any of the following additional materials such as an composite alloy, fiberglass, nylon, other water proof material, rubberized grips, flexible material, ribbon of flexible sheet material, elastic cord, chain link, metal links, rope, or the like can be used as well as other appropriate material for the apparatus 10 such as webbing, fabric, including UV-resistant polyester, may be used. The apparatus 10 can be also made in all black and also in all camoflauge or any combination of these and/or other colors. The retaining bracket for this apparatus 10 can also include but is not limited to any of the following: bracket, fastener, or similar buckle shapes.

While the preferred embodiment of the invention have been described above, it will be appreciated by those skilled in the art that various modifications and alternatives to the disclosed embodiments may be developed in light of the overall teachings of the disclosure. Accordingly, the disclosed embodiments are meant to be illustrative only and not limiting to the scope and spirit of the invention which is to be given the full breadth of the following claim and all equivalents thereof.

It is to be understood that the present invention is by no means limited to the particular constructions herein disclosed and/or shown in the drawings, but also comprises any modifications or equivalents within the scope of the claims.

The invention claimed is:

1. A method for execution by a user of a tree stand apparatus, comprising the steps of:

attaching a support member to a tree stand, wherein at least a portion of the support member extends below an underside of the tree stand; the support member being in the form of a strap that is fastened to the tree stand at each end of the strap; the step of attaching the support member to a tree stand further includes the steps of folding an end of the strap over a part of the tree stand so as to form a loop that surrounds the part of the tree stand and threading the strap through a retaining clip so as to secure the loop;

mounting the tree stand on a tree; and supporting at least a portion of the user's weight with the support member while climbing into the tree stand.

2. The method of claim 1, wherein the step of attaching the support member to the tree stand further includes the step of:

connecting a fastener on the support member to a corresponding location on the tree stand.

* * * * *